US006562156B2

(12) United States Patent
Liu

(10) Patent No.: US 6,562,156 B2
(45) Date of Patent: May 13, 2003

(54) ECONOMIC MANUFACTURING OF BULK METALLIC GLASS COMPOSITIONS BY MICROALLOYING

(75) Inventor: Chain T. Liu, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/921,030

(22) Filed: Aug. 2, 2001

(65) Prior Publication Data

US 2003/0034099 A1 Feb. 20, 2003

(51) Int. Cl.[7] ..... C22C 45/10
(52) U.S. Cl. ..... 148/561; 148/403
(58) Field of Search ..... 148/561, 403

(56) References Cited

U.S. PATENT DOCUMENTS

| | | | | |
|---|---|---|---|---|
| 3,940,293 | A | | 2/1976 | Polk et al. |
| 4,116,682 | A | | 9/1978 | Polk et al. |
| 4,318,738 | A | | 3/1982 | Masumoto et al. |
| 4,557,766 | A | | 12/1985 | Tenhover et al. |
| 4,653,500 | A | | 3/1987 | Osada et al. |
| 4,762,677 | A | | 8/1988 | Dolgin |
| 4,762,678 | A | | 8/1988 | Dolgin |
| 4,827,931 | A | | 5/1989 | Longmore |
| 4,880,482 | A | | 11/1989 | Hashimoto et al. |
| 5,032,196 | A | * | 7/1991 | Masumoto et al. ..... 148/403 |
| 5,169,597 | A | | 12/1992 | Davidson et al. |
| 5,190,546 | A | | 3/1993 | Jervis |
| 5,288,344 | A | * | 2/1994 | Peker et al. ..... 148/403 |
| 5,290,266 | A | | 3/1994 | Rohling et al. |
| 5,324,368 | A | | 6/1994 | Masumoto et al. |
| 5,372,660 | A | | 12/1994 | Davidson et al. |
| 5,380,375 | A | | 1/1995 | Hashimoto et al. |
| 5,460,663 | A | | 10/1995 | Hashimoto et al. |
| 5,482,580 | A | | 1/1996 | Scurggs et al. |
| 5,549,797 | A | | 8/1996 | Hashimoto |
| 5,578,359 | A | | 11/1996 | Forbes et al. |
| 5,618,359 | A | | 4/1997 | Lin et al. |
| 5,647,361 | A | | 7/1997 | Damadian |
| 5,711,363 | A | | 1/1998 | Scruggs et al. |
| 5,735,975 | A | | 4/1998 | Lin et al. |
| 5,772,803 | A | | 6/1998 | Peker et al. |
| 5,797,443 | A | | 8/1998 | Lin et al. |
| 5,803,996 | A | | 9/1998 | Inoue et al. |
| 5,895,401 | A | | 4/1999 | Daum et al. |
| 5,976,274 | A | | 11/1999 | Inoue et al. |
| 5,980,652 | A | | 11/1999 | Inoue et al. |
| 6,027,586 | A | | 2/2000 | Masumoto et al. |
| 6,077,367 | A | | 6/2000 | Mizushima et al. |
| 6,306,228 | B1 | | 10/2001 | Inoue et al. |

OTHER PUBLICATIONS

John F. Schenck, "The Role of Magnetic Susceptibility in Magnetic Resonance Imaging: MRI Magnetic Compatibility of the First and Second Kinds," Med. Phys., vol. 23 (No. 6), Jun. 1966, p. 815–850.

Akihisa Inoue, "Stabilization of Metallic Supercooled Liquid and Bulk Amorphous Alloys," Acta Mater., 48, (2000), pp. 279–306.

Akihisa Inoue, Tao Zhang and Tsuyoski Masumoto, "Preparation of Bulky Amorphous Zr–Al–Co–Ni–Cu Alloys to Copper Mold Casting and Their Thermal and Mechanical Properties," Materials Transactions, JIM, vol. 36 (No. 3), (1995), pp. 391–398.

Akihisa Inoue, Tsutomu Shibata and Tao Zhang, "Effect of Additional Elements on Glass Transition Behavior and Glass Formation Tendency of Zr–Al–Cu–Ni Alloys," Materials Transactions, JIM, vol. 36 (No. 12), (1995), pp. 1420–1426.

X. H. Lin, W.L. Johnson and W. K. Rhim, "Effect of Oxygen Impurity on Crystallization of an Undercooled Bulk Glass Forming Zr–Ti–Cu–Ni–Al Alloy," Materials Transactions, JIM, vol. 38 (No. 5), (1997), p. 473–477.

W. L. Johnson, "Fundamental Aspects of Bulk Metallic Glass Formation in Multicomponent Alloys," Materials Science Forum vols. 225–227 (1996), p. 35–50.

* cited by examiner

*Primary Examiner*—Roy King
*Assistant Examiner*—Andrew Wessman
(74) *Attorney, Agent, or Firm*—Joseph A. Marasco

(57) ABSTRACT

A method of making a bulk metallic glass composition includes the steps of:

a. providing a starting material suitable for making a bulk metallic glass composition, for example, BAM-11;

b. adding at least one impurity-mitigating dopant, for example, Pb, Si, B, Sn, P, to the starting material to form a doped starting material; and c. converting the doped starting material to a bulk metallic glass composition so that the impurity-mitigating dopant reacts with impurities in the starting material to neutralize deleterious effects of the impurities on the formation of the bulk metallic glass composition.

14 Claims, 4 Drawing Sheets

ECONOMIC MANUFACTURING OF BULK METALLIC GLASS COMPOSITIONS BY MICROALLOYING

The United States Government has rights in this invention pursuant to contract no. DE-AC05-00OR22725 between the United States Department of Energy and UT-Battelle, LLC.

FIELD OF THE INVENTION

The present invention relates to methods of manufacturing bulk metallic glass compositions, and more particularly to such methods that involve microalloying with impurity-mitigating dopants.

BACKGROUND OF THE INVENTION

Bulk metallic glasses (BMGs) constitute a new class of metallic materials with attractive properties, for example, extremely high specific strength and unique deformation behavior. BMGs are suitable for many structural and functional applications, including: submarine, ship, aeronautical and aerospace materials, especially for defense industries; die and mold materials for manufacturing industries; recreation materials such as golf club heads, fishing rods, bicycles, etc.; soft magnetic materials for engineering control systems; and, especially, medical instruments. See U.S. patent application Ser. No. 09/799,445 filed on Mar. 5, 2001 by Joseph A Horton Jr. and Douglas E. Parsell entitled "Bulk Metallic Glass Medical Instruments, Implants and Methods of Using Same", the entire disclosure of which is incorporated herein by reference.

It is well established that interstitial impurities, such as oxygen and nitrogen, which are generally present in charge materials, have an adverse effect on the critical cooling rate necessary for the formation of glass states in Zr-base BAM systems. In general, oxygen concentrations of about one thousand pairs per million in weight (wppm) are known to reduce the glass forming ability and increase the critical cooling rate of these BAMs by several orders of magnitude. Because of the harmful effect of oxygen, high-purity Zr metal has been required for manufacturing BAM parts with large cross sections. The disadvantage of this approach is that high-purity charge materials are very expensive and substantially increase the material and processing, costs. For instance, the price of commercially pure Zr metal may be in the order of $50 per lb, and greater than $500 per lb for high-purity Zr necessary for producing glass states. Moreover, such an approach requires processing in ultra-clean systems in order to avoid oxygen contamination of BAMs, resulting in the further increase of production cost.

EXAMPLE I

In order to demonstrate the harmful effect of oxygen impurity on the glass forming ability of BMGs, a well known Zr-base BMG alloy, BAM-11, with the composition of 10 at. % Al, 5 at. % Ti, 17.9 at. % Cu, 14.6 at. % Ni, balance Zr, was selected as a model material for study. Two Zr metal sources were chosen for alloy preparation: one was a high-purity (HP) metal containing 560 wppm oxygen and the other was a commercial-pure (CP) metal containing 4460 wppm oxygen. The purchase prices per pound for Zr metal were $54 for Zr (CP) and $546 for Zr (HP). Alloy ingots were prepared by arc melting and drop casting into a copper mold of ¼" diameter.

FIGS. 1*a* and 1*b* show back-scattered electron micrographs of these two alloy ingots, respectively: BAM-11 (HP) and BAM-11 (CP). Comparison thereof indicated that the glass phase was formed in BAM-11 (HP) and crystalline phase was formed in BAM-11 (CP) in the central region of the alloy ingots. Thus, the oxygen impurity in CP Zr dramatically and deleteriously reduced the glass forming(g ability of the BMG alloy. Tensile specimens were prepared from these two ingots and tested at room temperature in air. As indicated in Table 1, the oxygen impurity, which suppressed the glass state in the CP material, also reduced the tensile fracture strength of BAM-11 from 1730 MPa for the HP material down to essentially zero for the CP material at room temperature.

TABLE 1

Effect of Zr Purity on Tensile Properties Of BMGs Tested at Room Temperature

| Alloy No. | Zr Material[a] | Dopants | Fracture Strength (MPa) |
|---|---|---|---|
| BAM-11 | HP | None | 1730 |
| BAM-11 | CP | None | ~0[b] |

[a]HP = high-purity Zr (O = 560 wppm)
CP = commercial-pure Zr (O = 4460 wppm)
[b]Specimens were broken during machining The impurity problem must be solved satisfactorily in order to achieve feasibility of BMGs for General engineering use and commercial products at reasonable cost. It is thus vital to develop a new and improved method to manufacture BMGs for commercialization.

OBJECTS OF THE INVENTION

Accordingly, objects of the present invention include: neutralization of the harmful effect of interstitial impurities in charge materials used for BMG production so that relatively impure materials can be used to manufacture BMGs economically. Further and other objects of the present invention will become apparent from the description contained herein.

SUMMARY OF THE INVENTION

In accordance with one aspect of the present invention, the foregoing and other objects are achieved by a method of making a bulk metallic glass composition including, the steps of a. providing a starting material suitable for making a bulk metallic lass composition;

b. adding at least one impurity-mitigating dopant to the starting material to form a doped starting material; and c. converting the doped starting material to a bulk metallic glass composition so that the impurity-mitigating dopant reacts with impurities in the starling material to neutralize deleterious effects of the impurities on the formation of the bulk metallic glass composition.

In accordance with another aspect of the present invention, a bulk metallic glass composition includes a bulk metallic glass which comprises at least one impurity-mitigating dopant.

For a better understanding of the present invention, together with other and further objects, advantages and capabilities thereof reference is made to the following disclosure and appended claims in connection with the above-described drawings.

DETAILED DESCRIPTION OF THE INVENTION

The approach of the present invention is to add small amounts (usually less than 1 at. %) of microalloying additions to the base alloy composition in order to alleviate the harmful effect of oxygen and other impurities. These microalloying additions (referred to hereinafter as impurity-mitigating dopants or dopants) react with oxygen and/or other impurities to form innocuous precipitates in the glass matrix. Dopants can be used alone or in combination. Preferred dopants, especially for Zr-containing base alloys, include B, Si, and Pb. Other dopants that are contemplated to have a beneficial effect in accordance with the present invention include, but are not limited to, Sn and P. The composition of the dopant is not critical to the invention, but rather the effect of the dopant—the reaction of the dopant(s) with oxygen and/or other impurities to form innocuous precipitates in the glass matrix of the BMG.

EXAMPLE II

BMG compositions were made as in Example I using B, Si, and Pb as dopants. Table 2 shows the alloy compositions (BAM-23 to BAM-44) where the dopants at different amounts were added to the base composition of BAM-11. Sample alloys were prepared by arc melting and drop casting into an ¼"-diameter copper mold, using CP and HP Zr metals.

All of the alloys prepared by HP Zr metal showed essentially the glass phase and were characterized by the same desirable mechanical properties of the base alloy BAM-11 (HP). Therefore, the dopants had no deleterious effects on the product.

Figure 1A:
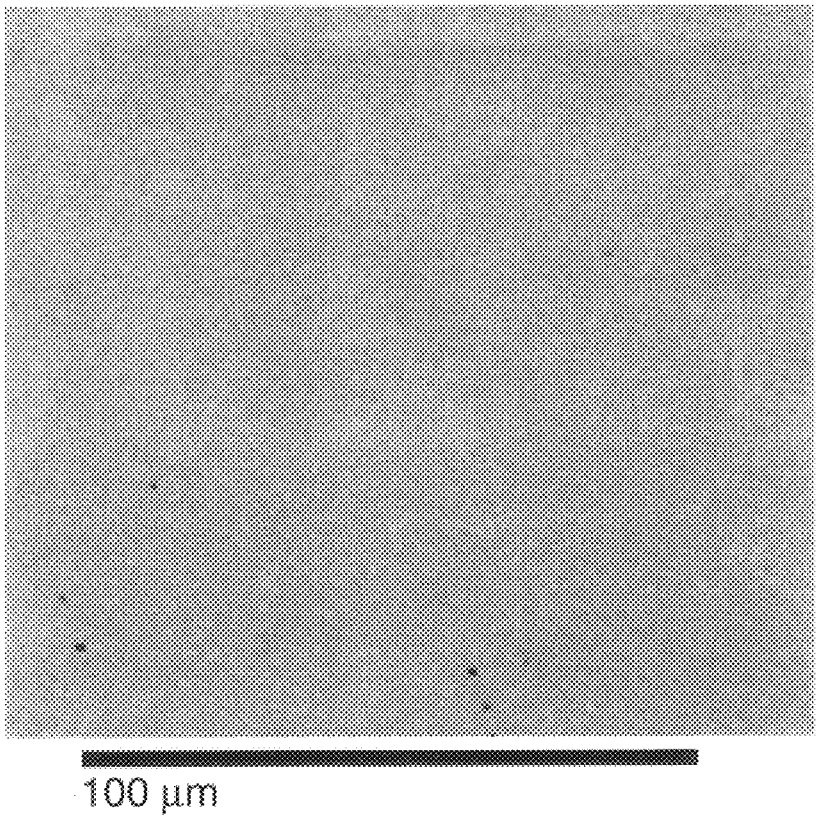
FIG. 1*a* is a back-scattered electron micrograph of a (HP) BAM-11 alloy ingot showing a basically glassy structure with some crystalline structure.
Figure 1B:
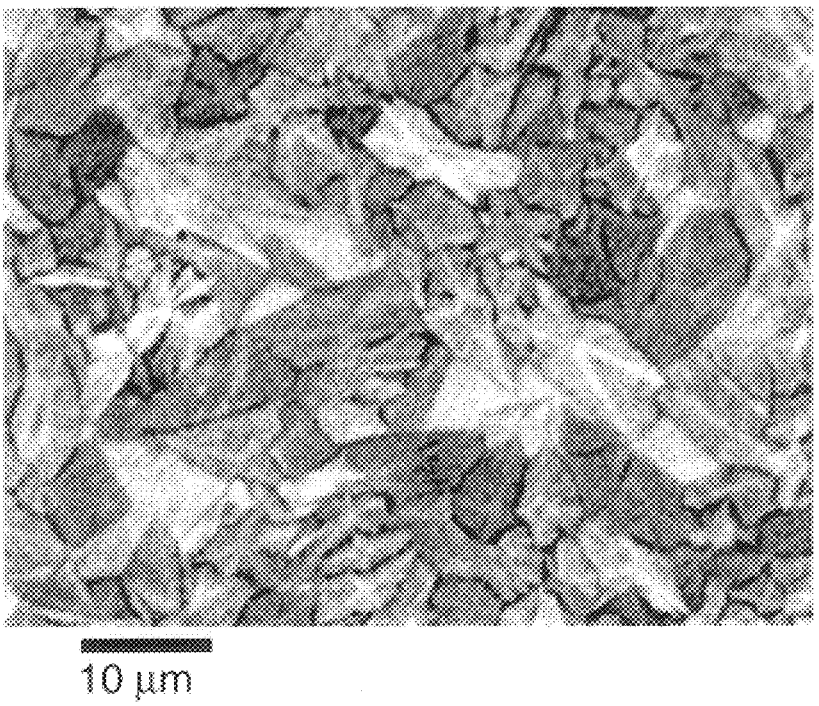
FIG. 1*b* is a back-scattered electron micrograph of a (CP) BAM-11 alloy ingot showing a crystalline structure.
Figure 2A:
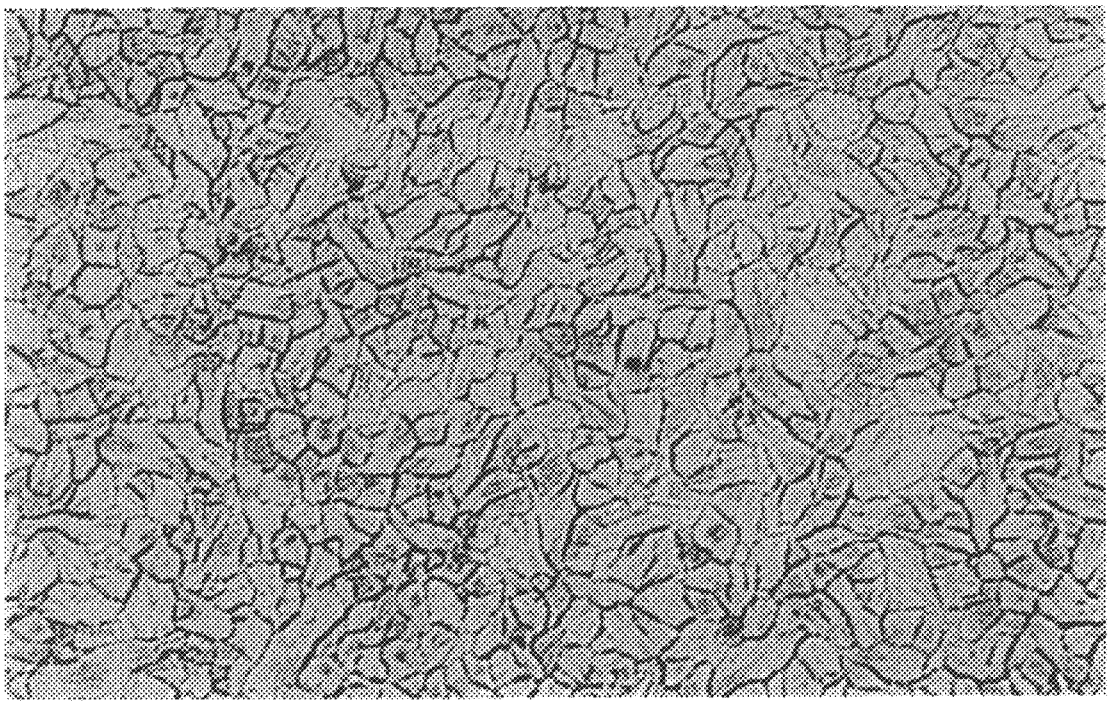
FIG. 2*a* is a 500× optical micrograph of a (CP) BAM-11 base alloy showing a crystalline structure.
Figure 2B:
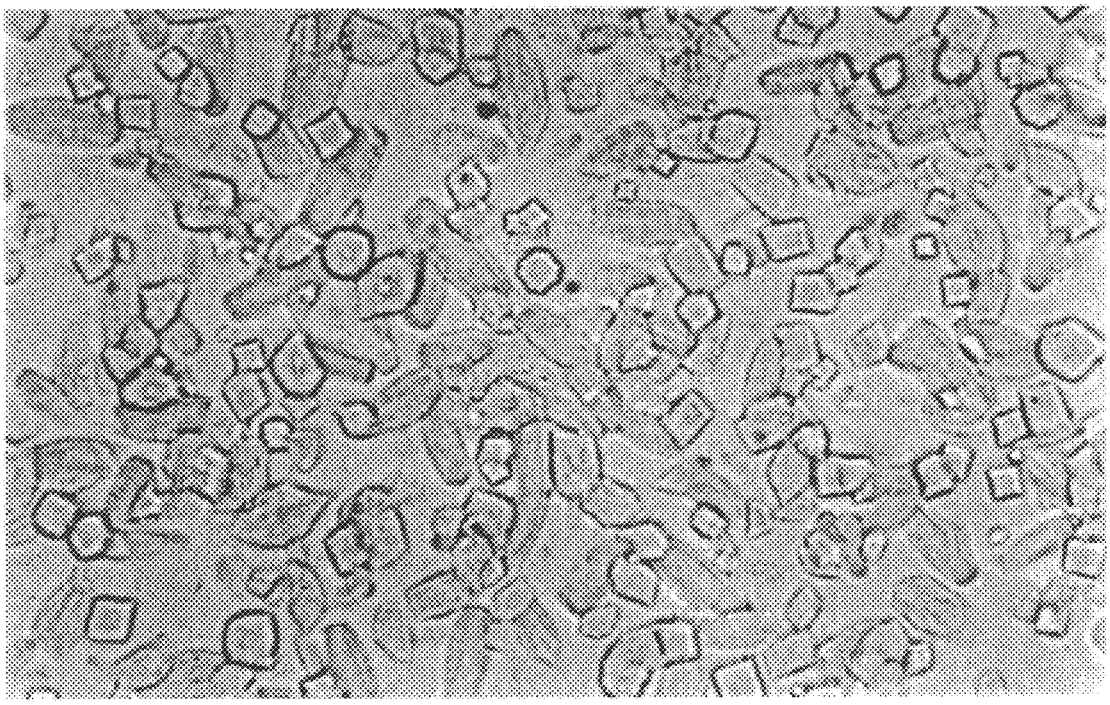
FIG. 2*b* is a 500× optical micrograph of a (CP) BAM-39 alloy doped with 0.020 at. % Si and 0.10 at. % B showing glassy and crystalline structure.
Figure 2C:
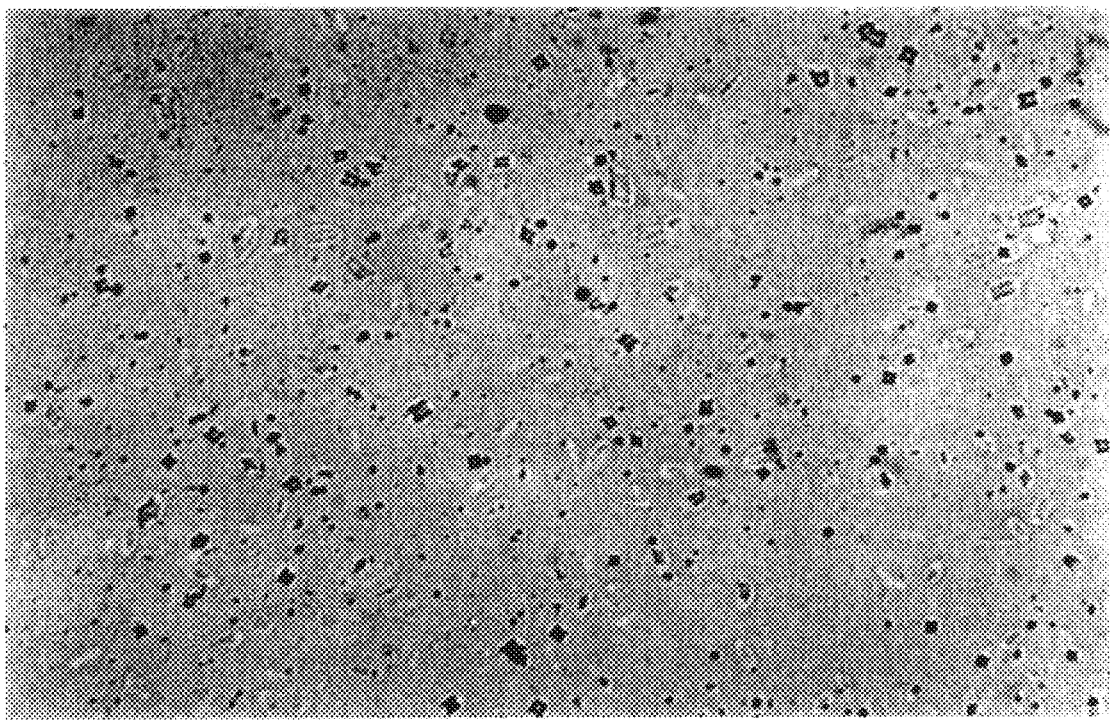
FIG. 2*c* is a 500× optical micrograph of a (CP) BAM-44 alloy doped with 0.1 at. % Pb showing glassy structure and a reduced amount of crystalline structure in accordance with the present invention.
Figure 2D:
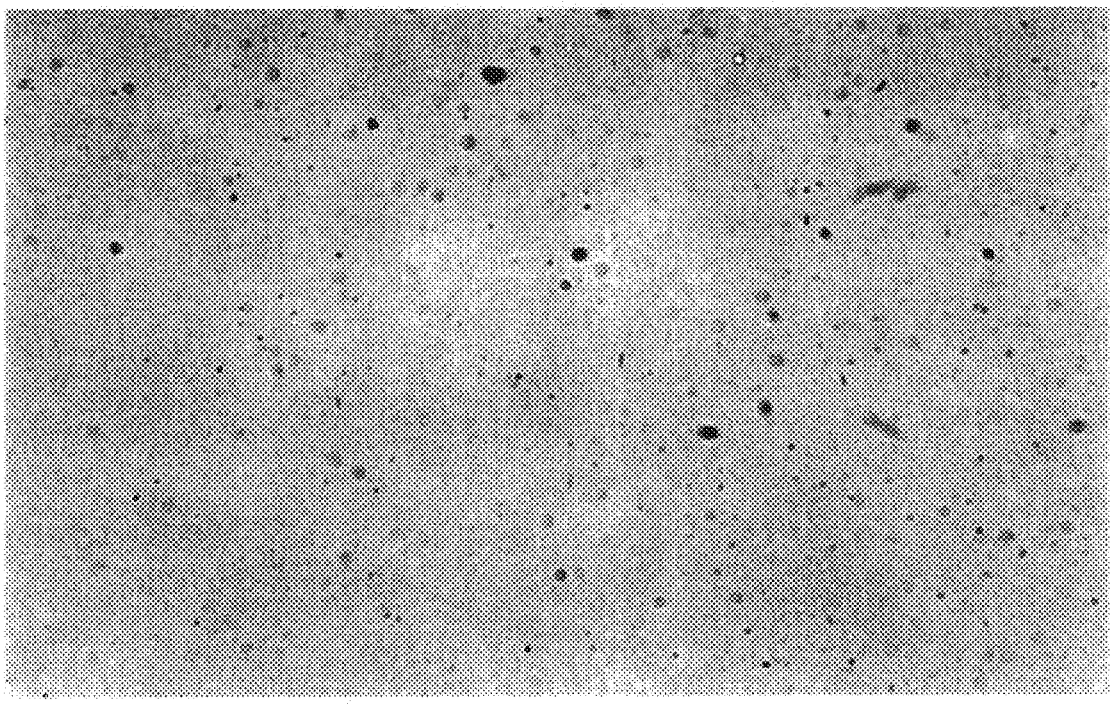
FIG. 2*d* is a 500× optical micrograph of a (CP) BAM-41 alloy doped with 0.1 at. % Pb, 0.020 at. % Si and 0.10 at. % B showing glassy structure and a greatly reduced amount of crystalline structure in accordance with the present invention.

The dopants were shown to have an unexpectedly dramatic effect on BAM-11 prepared using CP Zr metal. FIGS. 2*a*–2*d* show the optical microstructure of BAM alloys doped with different microalloying, additions. FIG. 2*a* shows that the base alloy sample BAM-11 without dopants taught and described herein exhibits fully crystalline grain structures in the central region of the alloy ingot. FIG. 2*b* shows sample BAM-39, which had the same composition as BAM-11 except doping with 0.20 at. % Si and 0.10 at. % B, exhibited dispersed crystalline particles in the glass state matrix. Both the amount and the size of crystalline phase particles decreased substantially in sample BAM-44 doped with 0.10 at. % Pb as shown in FIG. 2*c*. This comparison clearly indicates that the microalloying element Pb is very effective in suppressing the formation of crystalline phases. FIG. 2*d* shows that an even better result is obtained in the alloy sample BAM-41 doped with 0.20 at. % Si, 0.10 at. % B and 0.1 0 at. % Pb, which showed essentially the glass phase with very little crystalline structure. The examination of the microstructures reveals that microalloying with a combination of Pb, Si and B is quite usefully effective in increasing the glass forming ability and suppressing the formation of crystalline phases in BAM-11 prepared with impure Zr containing a high level of oxygen impurity.

It was noted that microalloying with carbon had no beneficial effect on oxygen impurity.

Figure 3:
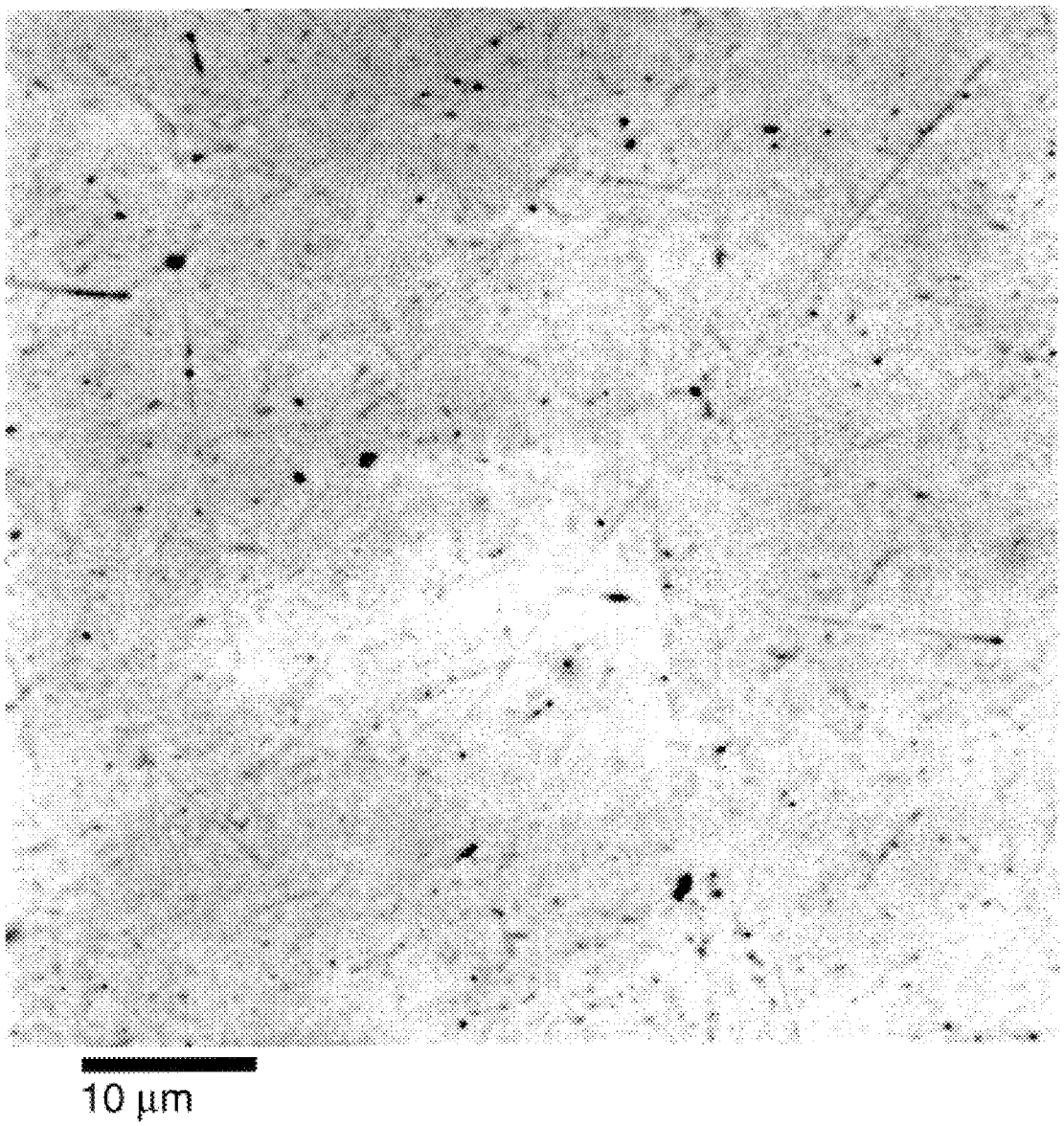
FIG. 3 is a back-scattered electron micrograph of a (CP) BAM-41 alloy doped with 0.1 at. % Pb, 0.020 at. % Si and 0.10 at. % B showing glassy structure and innocuous inclusions in accordance with the present invention.

The micro structural features in BAM-41 doped with 0.20 at. % Si, 0. 10 at. % B and 0.10 at. % Pb were examined using an electron microprobe. As shown in FIG. 3, tiny black particles were observed at a high magnification. These fine particles contained roughly 10 at. % oxygen, suggesting that these dopants are effective in scavenging oxygen from the glass matrix by formation of innocuous particles.

The mechanical properties of BAM alloys doped with different microalloying additions were measured by tensile testing at room temperature in air as shown in Table 2. Similarly to the BAM-11 made from CP Zr, BAM-37 and BAM-39 doped with Si and B showed essentially no fracture strength. The embrittlement is believed to be due to the oxygen impurity that causes the formation of brittle crystalline phases. BAM-42 (CP) doped with 0.05 at. % Pb, 0.20 at. % Si, 0.10 at. % B was characterized by fracture strength of 285 MPa, which was significantly lower than that of BAM-11 (HP). The best result was obtained from BAM-41 (CP) doped with 0.1 at. % Pb, 0.20 at. % Si, 0.10 at. % B, which was characterized by fracture strength of 1520 MPa, close to that of BAM-11 (HP). This comparison indicates that microalloying with 0.1 at. % Pb, 0.20 at. % Si, 0.10 at. % B is most effective in removing oxygen impurity from the glass matrix via the formation of innocuous particles.

Increased doping of the base alloy with 0.2 at. % Pb, 0.2 at. % Si, 0.1 at. % B caused a decrease in the fracture strength from 1520 to 1300 MPa. Therefore, it is contemplated that operable doping levels are in the ranges of about: <1 at. % Pb, <1 at. % Si, and <1 at. % B. Preferable doping levels are in the ranges of about: 0.02 to 0.5 at. % Pb, 0.02 to 0.5 at. % Si, and 0.02 to 0.7 at. % B. More preferable doping levels are in the ranges of about: 0.08 to 0.4 at. % Pb, 0.08 to 0.4 at. % Si, and 0.08 to 0.5 at. % B. Still more preferable doping levels are in the ranges of about: 0.1 to 0.3 at. % Pb, 0.1 to 0.3 at. % Si, and 0.1 to 5 0.4 at. % B. These doping levels are contemplated to also apply to other dopants such as Sn and P.

TABLE 2

Effect of Microalloying Dopants on Tensile Properties Of BMGs Tested at Room Temperature

| Alloy No. | Zr Material[a] | Dopants | Fracture Strength (MPa) |
|---|---|---|---|
| BAM-37 | CP | 0.15 Si—0.10 B | ~0[h] |
| BAM-39 | CP | 0.20 Si—0.10 B | ~0[h] |
| BAM-42 | CP | 0.20 Si—0.10 B—0.05 Pb | 285 |
| BAM-41 | CP | 0.20 Si—0.10 B—0.10 Pb | 1520 |
| BAM-43 | CP | 0.20 Si—0.10 B—0.20 Pb | 1300 |
| BAM-11 | HP | None | 1730 |
| BAM-11 | CP | None | ~0[b] |

[a]HP = high-purity Zr (O = 560 wppm)
CP = commercial-pure Zr (O = 4460 wppm)
[h]Specimens were broken during machining

TABLE 3

Alloy Compositions of BMGs Prepared by Arc Melting and Drop Casting

| Alloy No. | Alloy Composition (at %) |
|---|---|
| BAM-11 | Zr—10.00 Al—5.0 Ti—17.9 Cu—14.6 Ni |
| BAM-23 | Zr—10.00 Al—5.0 Ti—17.9 Cu—14.6 Ni—0.10 B |
| BAM-24 | Zr—10.00 Al—5.0 Ti—17.9 Cu—14.6 Ni—0.20 B |
| BAM-25 | Zr—10.00 Al—5.0 Ti—17.9 Cu—14.6 Ni—0.30 B |
| BAM-26 | Zr—10.00 Al—5.0 Ti—17.9 Cu—14.6 Ni—0.40 B |
| BAM-38 | Zr—9.95 Al—5.0 Ti—17.9 Cu—14.6 Ni—0.05 Si—0.10 B |
| BAM-40 | Zr—9.90 Al—5.0 Ti—17.9 Cu—14.6 Ni—0.10 Si |
| BAM-37 | Zr—9.90 Al—5.0 Ti—17.9 Cu—14.6 Ni—0.10 Si—0.10 B |
| BAM-39 | Zr—9.90 Al—5.0 Ti—17.9 Cu—14.6 Ni—0.20 Si—0.10 B |
| BAM-42 | Zr—9.90 Al—5.0 Ti—17.9 Cu—14.6 Ni—0.20 Si—0.10 B—0.05 Pb |
| BAM-44 | Zr—9.90 Al—5.0 Ti—17.9 Cu—14.6 Ni—0.10 Pb |
| BAM-41 | Zr—9.90 Al—5.0 Ti—17.9 Cu—14.6 Ni—0.20 Si—0.10 B—0.10 Pb |
| BAM-43 | Zr—9.90 Al—5.0 Ti—17.9 Cu—14.6 Ni—0.20 Si—0.10 B—0.20 Pb |

The tensile results and microstructural analyses clearly indicate that microalloying (doping) with Pb, Si and B is effective in alleviating the harmful effect of oxygen impurity in charge materials used to prepare BMGs. The optimum doping levels are expected to vary with the amount of impurities in charge materials as well as with alloy compositions.

It is important to point out that the beneficial dopants disclosed herein have been shown to effectively suppress the harmful effects of impurities in Zr and make low-cost impure Zr metal feasible to be used as charge material for economic production of BMGs having sufficiently good mechanical and other properties for use in various applications.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A method of making a bulk metallic glass composition comprising the steps of:

a. providing a Zr-base starting material suitable for making a bulk metallic glass composition;

b. adding at least one impurity-mitigating dopant to said starting material to form a doped starting material, said impurity-mitigating dopant comprising Pb; and c. converting said doped starting material to a bulk metallic glass composition so that said at least one impurity-mitigating dopant reacts with impurities in said starting material to neutralize deleterious effects of said impurities on the formation of said bulk metallic glass composition.

2. A method in accordance with claim 1 wherein said Zr-base material further comprises 10 at. % Al, 5 at. % Ti, 17.9 at. % Cu, 14.6 at. % Ni, balance Zr.

3. A method in accordance with claim 1 wherein said impurity-mitigating dopant further comprises at least one element selected from the group consisting of B, Si, Sn, and P.

4. A method in accordance with claim 1 wherein said Zr-base material further comprises 10 at. % Al, 5 at. % Ti, 17.9 at. % Cu, 14.6 at. % Ni, balance Zr, and said impurity-mitigating dopant further comprises at least one element selected from the group consisting of <1 at. % Pb, <1 at % Si, and <1 at. % B.

5. A method in accordance with claim 4 wherein said impurity-mitigating dopant further comprises at least one element selected from the group consisting of 0.02 to 0.5 at. % Pb, 0.02 to 0.5 at. % Si, and 0.02 to 0.7 at. % B.

6. A method in accordance with claim 5 wherein said impurity-mitigating dopant further comprises at least one element selected from the group consisting of 0.08 to 0.4 at. % Pb, 0.08 to 0.4 at. % Si, and 0.08 to 0.5 at. % B.

7. A method in accordance with claim 6 wherein said impurity-mitigating dopant further comprises at least one element selected from the group consisting of 0.1 to 0.3 at. % Pb, 0.1 to 0.3 at. % Si, and 0.1 to 0.4 at. % B.

8. A bulk metallic glass composition comprising Zr-base a bulk metallic glass which comprises at least one impurity-mitigating dopant, said impurity-mitigating dopant comprising Pb.

9. A bulk metallic glass composition in accordance with claim 8 wherein said Zr-base material further comprises 10 at. % Al, 5 at. % Ti, 17.9 at. % Cu, 14.6 at. % Ni, balance Zr.

10. A bulk metallic glass composition in accordance with claim 8 wherein said impurity-mitigating dopant further comprises at least one element selected from the group consisting of B, Si, Sn, and P.

11. A bulk metallic glass composition in accordance with claim 8 wherein said Zr-base material further comprises 10 at. % Al, 5 at. % Ti, 17.9 at. % Cu, 14.6 at. % Ni, balance Zr, and said impurity-mitigating dopant further comprises at least one element selected from the group consisting of <1 at. % Pb, <1 at. % Si, and <1 at. % B.

12. A bulk metallic glass composition in accordance with claim 11 wherein said impurity-mitigating dopant further comprises at least one element selected from the group consisting of 0.02 to 0.5 at. % Pb, 0.02 to 0.5 at. % Si, and 0.02 to 0.7 at. % B.

13. A bulk metallic glass composition in accordance with claim 12 wherein said impurity-mitigating dopant further comprises at least one element selected from the group consisting of 0.08 to 0.4 at. % Pb, 0.08 to 0.4 at. % Si, and 0.08 to 0.5 at. % B.

14. A bulk metallic glass composition in accordance with claim 13 wherein said impurity-mitigating dopant further comprises at least one element selected from the group consisting of 0.1 to 0.3 at. % Pb, 0.1 to 0.3 at. % Si, and 0.1 to 0.4 at. % B.

* * * * *